US010986431B2

(12) United States Patent
Lamb et al.

(10) Patent No.: US 10,986,431 B2
(45) **Date of Patent: *Apr. 20, 2021**

(54) WEARABLE MICROPHONE HOUSING WITH BUILT-IN REDUNDANCY

(71) Applicant: Point Source Audio, Inc., Petaluma, CA (US)

(72) Inventors: James Lamb, Novato, CA (US); Yvonne Ho, Novato, CA (US)

(73) Assignee: Point Source Audio, Inc., Petaluma, CA (US)

( * ) Notice: Subject to any disclaimer, the term of this patent is extended or adjusted under 35 U.S.C. 154(b) by 8 days.

This patent is subject to a terminal disclaimer.

(21) Appl. No.: 16/559,581

(22) Filed: Sep. 3, 2019

(65) Prior Publication Data

US 2020/0021901 A1 Jan. 16, 2020

Related U.S. Application Data

(63) Continuation-in-part of application No. 15/727,576, filed on Oct. 7, 2017, now Pat. No. 10,764,675.

(51) Int. Cl.

| | |
|---|---|
| ***H04R 1/02*** | (2006.01) |
| ***H04R 1/08*** | (2006.01) |
| ***H04R 3/00*** | (2006.01) |
| ***H04R 1/40*** | (2006.01) |
| ***H04R 1/04*** | (2006.01) |

(52) U.S. Cl.

CPC ..... *H04R 1/08* (2013.01); *H04R 1/04* (2013.01); *H04R 1/406* (2013.01); *H04R 3/005* (2013.01)

(58) Field of Classification Search

CPC ..... H04R 1/02; H04R 1/105; H04R 1/08

USPC ..... 381/361–364, 366–367

See application file for complete search history.

(56) References Cited

U.S. PATENT DOCUMENTS

| | | | | |
|---|---|---|---|---|
| 800,055 | A | 9/1905 | Ayres | |
| 1,085,916 | A | 2/1914 | Hutchinson | |
| 1,422,877 | A * | 7/1922 | Maxfield | H04R 25/00 381/23.1 |
| 1,587,643 | A | 6/1926 | Nathaniel | |
| D74,984 | S | 4/1928 | Myers | |
| 2,337,953 | A | 12/1943 | Wirsching | |
| 2,513,746 | A | 7/1950 | Rohr | |
| 2,566,313 | A | 9/1951 | Cates | |
| 2,954,442 | A | 9/1960 | Mickenberg | |

(Continued)

OTHER PUBLICATIONS

Restriction Requirement for U.S. Appl. No. 15/727,576, dated Nov. 1, 2018.

(Continued)

*Primary Examiner* — Suhan Ni

(57) ABSTRACT

A wearable audio apparatus used to support multiple audio components, namely, microphones. The audio apparatus can have a single housing that contains the multiple audio components, or can have multiple housings that contain individual audio components. The housing can be easily worn by a user, such as by coupling to a headset, ear mount/hook, user's clothing, or user's body. The microphones can be acoustically matched for rapid swapping without requiring a separate audio setup. The audio components can be mounted astride, offset or near one another in the audio apparatus. The audio components can also be separately wired so that each audio component can be independently activated.

14 Claims, 14 Drawing Sheets

(56) References Cited

U.S. PATENT DOCUMENTS

| | | | | |
|---|---|---|---|---|
| D196,515 | S | 10/1963 | Flystad | |
| 3,375,333 | A * | 3/1968 | Hagopian | H04R 5/027 381/363 |
| 3,691,319 | A | 9/1972 | Bee | |
| D238,178 | S | 12/1975 | Kinnan | |
| 4,020,297 | A | 4/1977 | Brodie | |
| 4,090,042 | A | 5/1978 | Larkin | |
| D252,024 | S | 6/1979 | Fujita | |
| 4,206,324 | A * | 6/1980 | Horikawa | H04R 1/08 381/26 |
| 4,257,666 | A | 3/1981 | Schauer | |
| 4,273,969 | A | 6/1981 | Foley | |
| 4,289,938 | A | 9/1981 | Zichy | |
| D274,839 | S | 7/1984 | Libby | |
| D280,323 | S | 8/1985 | Scheid | |
| D281,420 | S | 11/1985 | Rosenthal | |
| 4,617,431 | A | 10/1986 | Scott | |
| D295,169 | S | 4/1988 | Cho | |
| 4,861,276 | A | 8/1989 | Muller | |
| 4,911,510 | A | 3/1990 | Jenkins | |
| D309,305 | S | 7/1990 | von Hall | |
| D326,268 | S | 5/1992 | Le Tixerant | |
| 5,117,479 | A | 5/1992 | Erdman | |
| 5,210,792 | A | 5/1993 | Kajihara | |
| 5,324,209 | A | 6/1994 | Falossi | |
| 5,336,849 | A | 8/1994 | Whitney | |
| 5,348,494 | A | 9/1994 | Falossi | |
| D356,571 | S | 3/1995 | Garmon | |
| D362,008 | S | 9/1995 | McCumber | |
| 5,729,615 | A | 3/1998 | Yang | |
| D394,669 | S | 5/1998 | Becker | |
| 5,761,298 | A | 6/1998 | Davis | |
| 5,793,878 | A | 8/1998 | Chang | |
| 5,915,995 | A | 6/1999 | Meyer | |
| 5,987,147 | A * | 11/1999 | Nishimoto | H04R 5/033 381/375 |
| D418,512 | S | 1/2000 | Lin | |
| D421,755 | S | 3/2000 | Pitel | |
| D424,020 | S | 5/2000 | Fischer | |
| 6,097,827 | A | 8/2000 | Yang | |
| D441,739 | S | 5/2001 | Hayes | |
| 6,233,344 | B1 | 5/2001 | Clegg | |
| D449,038 | S | 10/2001 | Andreini | |
| 6,396,935 | B1 | 5/2002 | Makkonen | |
| D463,399 | S | 9/2002 | Konomi | |
| 6,456,721 | B1 | 9/2002 | Fukuda | |
| 6,584,984 | B2 | 7/2003 | Kelly | |
| D478,579 | S | 8/2003 | Sade | |
| 6,603,863 | B1 | 8/2003 | Nagayoshi | |
| D479,226 | S | 9/2003 | Beauregard | |
| 6,616,487 | B1 | 9/2003 | Lai | |
| D484,875 | S | 1/2004 | Higgins | |
| D498,251 | S | 11/2004 | Invencio | |
| D518,816 | S | 4/2006 | Naito | |
| D519,464 | S | 4/2006 | Suckle | |
| D519,990 | S | 5/2006 | Lazor | |
| 7,052,281 | B1 | 5/2006 | Meyberg | |
| D524,738 | S | 7/2006 | Dobler | |
| 7,231,056 | B2 | 6/2007 | Chen | |
| D553,567 | S | 10/2007 | Kawanobe | |
| D563,395 | S | 3/2008 | Pitcher | |
| D566,104 | S | 4/2008 | Suzuki | |
| D568,822 | S | 5/2008 | Kuo | |
| D573,101 | S | 7/2008 | Ng | |
| D575,772 | S | 8/2008 | Schultz | |
| D582,902 | S | 12/2008 | Crous | |
| 7,473,098 | B1 | 1/2009 | Poulos | |
| D585,881 | S | 2/2009 | Nam | |
| D586,759 | S | 2/2009 | Victor | |
| 7,520,763 | B1 | 4/2009 | Buse | |
| D593,075 | S | 5/2009 | Williams | |
| D596,127 | S | 7/2009 | Nania | |
| D597,947 | S | 8/2009 | Ono | |
| 7,613,292 | B2 | 11/2009 | te Riet | |
| 7,648,005 | B2 | 1/2010 | Leong | |
| D610,989 | S | 3/2010 | Arnidon | |
| D611,933 | S | 3/2010 | Burnham | |
| 8,009,853 | B2 | 8/2011 | Ito | |
| D645,028 | S | 9/2011 | Pescetto | |
| 8,107,664 | B2 | 1/2012 | Mao | |
| D693,773 | S | 11/2013 | Chen | |
| D713,385 | S | 9/2014 | Burgett | |
| D720,726 | S | 1/2015 | Yu | |
| 8,985,538 | B2 | 3/2015 | Rapoport | |
| D733,658 | S | 7/2015 | Yang | |
| D736,158 | S | 8/2015 | Rayner | |
| 9,271,065 | B2 | 2/2016 | Lamb | |
| D778,877 | S | 2/2017 | Lin | |
| 9,706,285 | B2 | 7/2017 | Lamb | |
| 9,761,993 | B2 | 9/2017 | Larkin | |
| D815,599 | S | 4/2018 | Kobayashi | |
| D815,600 | S | 4/2018 | Matsuoka | |
| 9,942,641 | B2 | 4/2018 | Lamb | |
| D825,468 | S | 8/2018 | Zeng | |
| 2002/0166691 | A1 | 11/2002 | Yaworski | |
| 2006/0073728 | A1 | 4/2006 | Zaiken | |
| 2006/0211293 | A1 | 9/2006 | Li | |
| 2008/0082168 | A1 | 4/2008 | Peterman | |
| 2008/0247590 | A1 | 10/2008 | Sun | |
| 2009/0285434 | A1 | 11/2009 | Williams | |
| 2010/0061581 | A1 | 3/2010 | Soetejo | |
| 2011/0256756 | A1 | 10/2011 | Lu | |
| 2012/0076342 | A1 | 3/2012 | Weber | |
| 2012/0149229 | A1 | 6/2012 | Kearsley | |
| 2013/0075149 | A1 | 3/2013 | Golka | |
| 2018/0317002 | A1 | 11/2018 | Castillo | |
| 2020/0006889 | A1 | 1/2020 | Lamb | |

OTHER PUBLICATIONS

Office Action for U.S. Appl. No. 15/727,576, dated Feb. 21, 2019.
Final Office Action for U.S. Appl. No. 15/727,576, dated Aug. 7, 2019.
Office Action for U.S. Appl. No. 15/727,576, dated Dec. 30, 2019.
Notice of Allowance for U.S. Appl. No. 15/727,576, dated Dec. 30, 2019.

* cited by examiner

WEARABLE MICROPHONE HOUSING WITH BUILT-IN REDUNDANCY

CROSS-REFERENCE TO OTHER APPLICATION

This application is a continuation-in-part of U.S. patent application Ser. No. 15/727,576, filed Oct. 7, 2017, entitled "WEARABLE MICROPHONE HOUSING WITH BUILT-IN REDUNDANCY," which is herein incorporated by reference.

BACKGROUND

Personal headsets for audio systems have been in use for many years, and for a variety of different applications. Users that typically desire quality audio headsets can include, for example, musical or theater artists, broadcasters, public speakers, telephone operators, dispatchers, airplane pilots, video camera operators, studio mixers, and professional sound technicians, among other various others. In many such occupations and applications, it may be desirable for such audio headsets to have speakers (e.g., earphones) and/or microphones. In the case of theater or musical productions, it is desirable that headset being worn by an artist not be noticeable to viewers, which can be members in an audience or viewers of a digital recording thereof.

Besides headsets, audio systems can also use wearable mountings (e.g., ear mounts or ear hooks) separate audio components, such as speakers or microphones. In one application, a microphone, as a separate component, is configured to be attached to a user (e.g., artist). The microphone is typically connected by wires to a wireless transmitter (sometimes referred to as a body-pack) that is also attached to the user. One type of microphone that is typically worn by a user is known as a lavalier microphone (or lavalier), which is a small microphone used for television, theatre, and public speaking applications in order to allow for hands-free operation.

Typically, a professional using a microphone with an audio headset, wearable mounting, or individual component would have a single microphone. A sound technician would check audio pickup from the microphone before the user starts her activity (e.g., show, shift, event, etc.). The microphone can be secured to a headset or ear mount/hook, or even to the user's body or clothing. The microphone might be integral with the headset, or attached to an ear mount/hook or to the user's body or clothing. A microphone can be attached to a user's body or clothing, such as with adhesive tape or cable binding sleeves (e.g., Hellerman sleeves). Regardless, audio setup is an important process and requires a period of time. Sometimes high end users, e.g., professionals, also configure another separate microphone which can be independently secured to a headset or ear mount/hook, or even to the user's body or clothing. The professional then wears two audio setups, which can be cumbersome or visually unappealing. Alternatively, the professional can wear only one audio setup and have the second one readily available for use should there be a problem with the first audio setup.

While such microphones, regardless of whether used as a separate component or not, normally yield high performance, sometimes there is a performance problem with the microphone or its wireless transmitter. When such a performance problem occurs during a live event of the artist or broadcaster, the problem is serious and must be resolved quickly.

Hence, there is a need for improved designs in which audio components are able to be efficiently provided and rendered easily swappable.

SUMMARY

The invention pertains to a wearable audio apparatus that is used to support multiple audio components. The audio apparatus can be worn separately or via another apparatus. The audio apparatus can have a single housing that contains the multiple audio components, or can have multiple housings that contain individual audio components. The housing can be easily worn by a user, such as by coupling to a headset, ear mount/hook, user's clothing, or user's body. The audio components can be acoustically matched for redundancy and rapid swapping without requiring a separate audio setup. The audio components can be mounted astride, offset or near one another in the audio apparatus. The audio components can also be separately wired so that each audio component can be independently activated. The housing can also be colored or camouflaged to match the user's skin or clothing.

Embodiments of the invention can be implemented in numerous ways, including as a device, apparatus, system or method. Several embodiments of the invention are discussed below.

As a wearable audio apparatus, one embodiment can, for example, include at least: a housing having an internal cavity; a first microphone positioned and secured within the internal cavity, the first microphone having a first audio responsiveness; a second microphone positioned and secured within the internal cavity, the second microphone having a second audio responsiveness; and a cover provided on a top portion of the housing, the cover having first and second apertures therein, the first aperture being aligned over the first microphone and the second aperture being aligned over the second microphone.

As an audio apparatus, another embodiment can, for example, include at least: a cable having a plurality of wires; a housing having a top region, a middle region and a bottom region, the top region having an opening, the middle region having an internal cavity, the bottom region having an opening for receiving the cable; a first microphone positioned and secured within the internal cavity, the first microphone having a first audio responsiveness; a second microphone positioned and secured within the internal cavity, the second microphone having a second audio responsiveness; an internal support structure provided internal to the housing at the bottom region, the internal support structure being configured to at least secure the cable to the bottom region and/or middle region of the housing; and a cover provided on a top portion of the housing, the cover having first and second apertures therein, the first aperture being over the first microphone and the second aperture being over the second microphone.

As an audio apparatus, still another embodiment can, for example, include at least: a first microphone housing having a first internal cavity; a first microphone positioned and secured within the first internal cavity of the first microphone housing, the first microphone having a first audio responsiveness; a second microphone housing having a second internal cavity; a second microphone positioned and secured within the second internal cavity of the second microphone housing, the second microphone having a second audio responsiveness; a base member; a first microphone extension having a forward end and a base end, the forward end being coupled to the first microphone housing, the rear end being coupled to the base member; and a second microphone extension having a forward end and a base end, the forward end being coupled to the second microphone housing, the rear end being coupled to the base member.

As a method for assembling a lavalier microphone assembly, one embodiment can, for example, include at least: providing a wearable housing have a cavity; identifying a pair of matching audio components; positioning and securing the pair of matching audio components within the wearable housing; receiving and securing a cable to the wearable housing, the cable including a plurality of wires; and electrically connecting one or more different ones of the wires within the cable to different ones of the audio components of the pair of matching audio components.

As a method for assembling a lavalier microphone assembly, another embodiment can, for example, include at least: providing a wearable structure; identifying a pair of matching audio components; positioning and securing the pair of matching audio components to or with the wearable structure such that the pair of matching audio components are adjacent but offset from one another; receiving and securing a plurality of wires to the wearable structure; and electrically connecting one or more different ones of the wires to different ones of the audio components of the pair of matching audio components.

Other aspects and advantages of embodiments of the invention will become apparent from the following detailed description taken in conjunction with the accompanying drawings which illustrate, by way of example, the principles of the invention.

BRIEF DESCRIPTION OF THE DRAWINGS

The accompanying drawings illustrate one or more exemplary embodiments and, together with the description of exemplary embodiments, serve to explain principles and implementations. The drawings are for illustration purposes and are not necessarily drawn to scale. The invention will be readily understood by the following detailed description in conjunction with the accompanying drawings, wherein like reference numerals designate like structural elements, and in which.

DETAILED DESCRIPTION OF EMBODIMENTS OF THE INVENTION

The invention pertains to a wearable audio apparatus that is used to support multiple audio components. The audio apparatus can be worn separately or via another apparatus. The audio apparatus can have a single housing that contains the multiple audio components, or can have multiple housings that contain individual audio components. The housing can be easily worn by a user, such as by coupling to a headset, ear mount/hook, user's clothing, or user's body. The audio components can be acoustically matched for redundancy and rapid swapping without requiring a separate audio setup. The audio components can be mounted astride, offset or near one another in the audio apparatus. The audio components can also be separately wired so that each audio component can be independently activated. The housing can also be colored or camouflaged to match the user's skin or clothing.

One type of audio component is a microphone. One suitable microphone is referred to as a lavalier microphone. By having more than one acoustically matched microphone in a common, compact housing of the audio apparatus, the housing is easily worn and contains a redundant microphone that can be rapidly activated without have to engage in an audio setup (e.g., sound check, etc.). In addition, in one embodiment, the microphones can be positioned in acoustically parallel positions within the housing to further provide acoustic equivalence. In another embodiment, the microphones can be offset or staggered to provide a low profile. The housing can also include a separate aperture for audio output for each of the microphones within the housing.

Further, the housing can also be colored or camouflaged to match the user's skin or clothing.

The various aspects, features, embodiments or implementations of the invention described above can be used alone or in various combinations.

Embodiments of various aspects of the invention are discussed below with reference to FIGS. 1-18. However, those skilled in the art will readily appreciate that the detailed description given herein with respect to these figures is for explanatory purposes as the invention extends beyond these limited embodiments.

Figure 1:
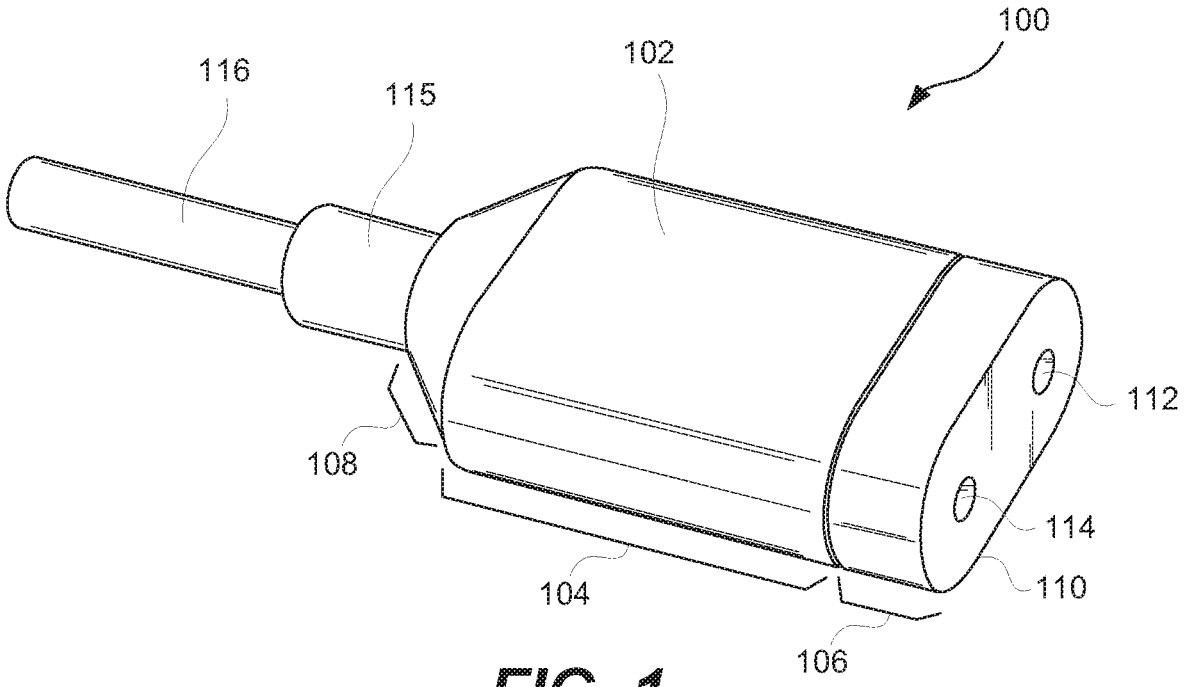
FIG. 1 is a perspective view of an audio apparatus according to one embodiment.

FIG. 1 is a perspective view of an audio apparatus 100 according to one embodiment. The audio apparatus 100 has a housing 102 with an internal cavity (as discussed in detail below) inside the housing 102. The internal cavity houses two or more audio components, namely, two or more microphones (not shown). The housing 102 can be considered as having a middle portion 104, a top portion 106 and a bottom portion 108. The middle portion 104 is configured to contain the two or more microphones in the internal cavity for audio pickup. The placement and use of the microphones within the internal hollow of the housing 102 are discussed in detail below. The top portion 106 includes a top piece (or cover) 110. The top piece 110 has apertures (or openings) 112 and 114 that extend through the top piece 110. Although FIG. 1 illustrates two apertures 112 and 114, in general, the top piece 110 can include an opening for each microphone contained within the housing 102. For example, if the internal cavity of the housing 102 housed four microphones, the top piece 110 may have four apertures. The bottom region 108 can be configured to receive a cable support structure 115. The cable support structure 115 is configured to receive and secure a cable 116 to the housing 102. The cable 116 can provide wires for electrical connection to the microphones. The cable support structure 115 can be secured to the housing 102 by mechanical interlock (e.g., complementary molded parts), adhesive, and any other know techniques. The cable 116 can be secured to the cable support structure 115 by adhesive, structural interference (e.g., friction), recess, detents, or any other known techniques.

As noted above, one type of audio component for use in the audio component 100 is a microphone for audio pickup. One suitable microphone is referred to as a lavalier microphone, which is a small electret or dynamic microphone, such as often use for theatre or and public speaking applications in order to allow for hands-free operation. Another type of audio component is an earphone. An earphone can, for example, also be or include an earbud.

Figure 2:
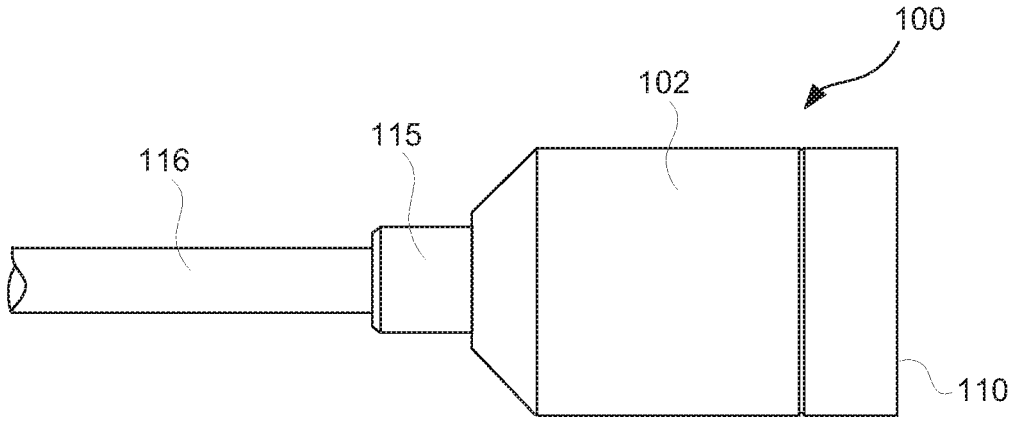
FIG. 2 is a top view of the audio apparatus shown in FIG. 1.
Figure 3:
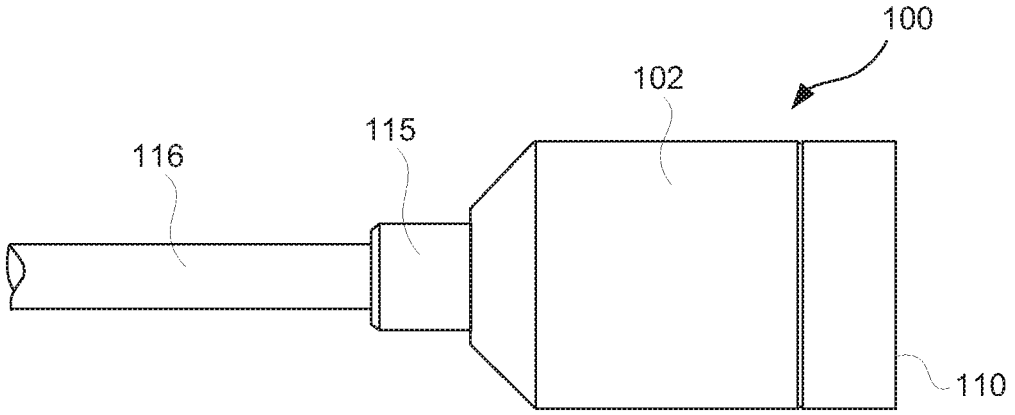
FIG. 3 is a bottom view of the audio apparatus shown in FIG. 1.
Figure 4:
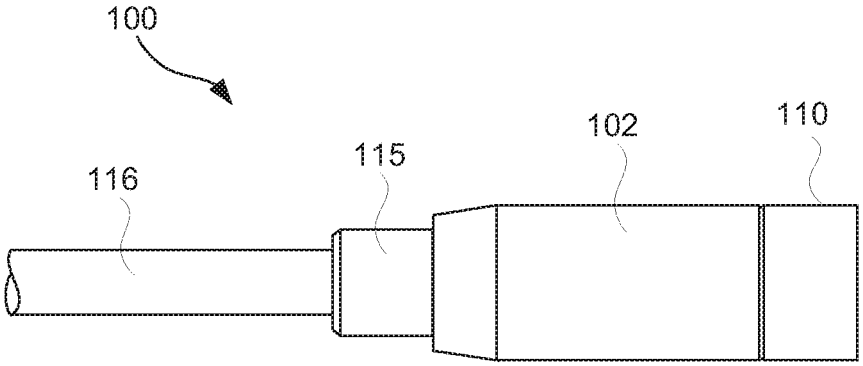
FIG. 4 is a left side view of the audio apparatus shown in FIG. 1.
Figure 5:
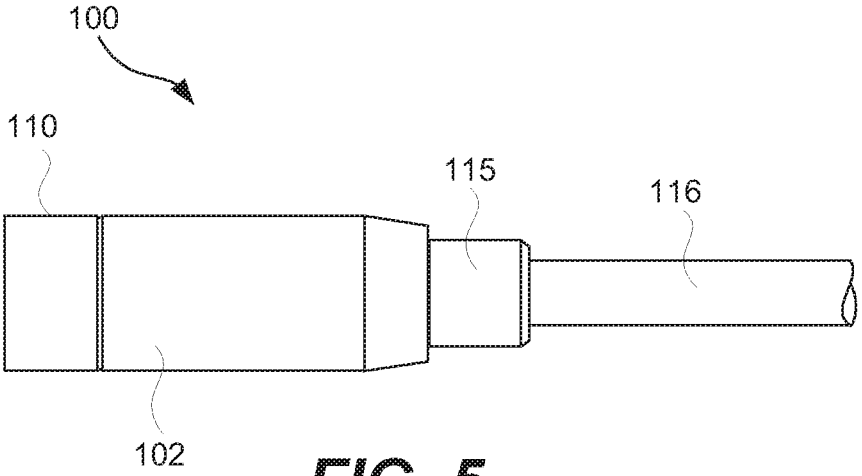
FIG. 5 is a right side view of the audio apparatus shown in FIG. 1.

FIG. 2 is a top view of the audio apparatus 100 shown in FIG. 1, and FIG. 3 is a bottom view of the audio apparatus 100 shown in FIG. 1. In addition, FIG. 4 is a left side view of the audio apparatus 100 shown in FIG. 1, and FIG. 5 is a right side view of the audio apparatus 100 shown in FIG. 1. As illustrated in FIGS. 2-4, the audio apparatus includes the housing 102 which receives the top piece 110 at one end and receives the cable 116 at the opposite end.

Figure 6:
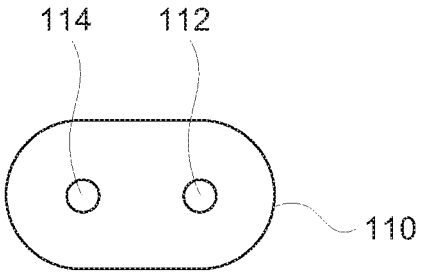
FIG. 6 is a front view of the audio apparatus shown in FIG. 1.

FIG. 6 is a front view of the audio apparatus 100 shown in FIG. 1. As illustrated, the top piece 110 for the housing 102 includes the apertures 112 and 114. The apertures 112 and 114 facilitates audio pickup by the microphones within the housing 102.

Figure 7:
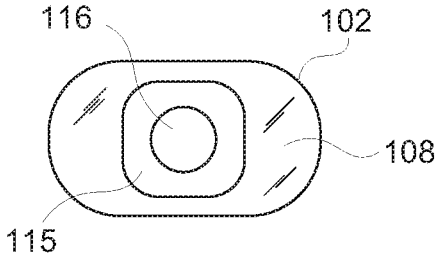
FIG. 7 is a back view of the audio apparatus shown in FIG. 1.

FIG. 7 is a back view of the audio apparatus 100 shown in FIG. 1. As illustrated, the bottom portion 108 of the housing 102 for the audio apparatus 100 is configured to receive the cable support structure 115, and the cable support structure is in turn configured to receive the cable 116 and to secure the cable 116 to the housing 102.

The particular configuration of the audio apparatus shown in FIGS. 1-7 is exemplary. Those skilled in the art will understand that the configuration and ornamental appearance of the audio apparatus can differ depending on implementation. As one example, the number of apertures for audio output can vary. As another example, the shape or configuration of the audio apparatus can vary. In one particular embodiment, the audio apparatus can by sized to about 13-14 mm in length, about 8-9 mm in width and 4-5 mm in height.

The audio apparatus can be formed by a molding process, such as injection molding. The housing and top for the audio apparatus can be formed on a variety of materials, including plastic, metal, ceramic, silicone, wood, and the like, or some combination thereof. In one implementation, the housing and top of the audio apparatus can be formed of a plastic material that can be molded into the desired configuration. For example, the plastic material can be made of Polyvinyl Chloride (PVC).

Figure 8A:
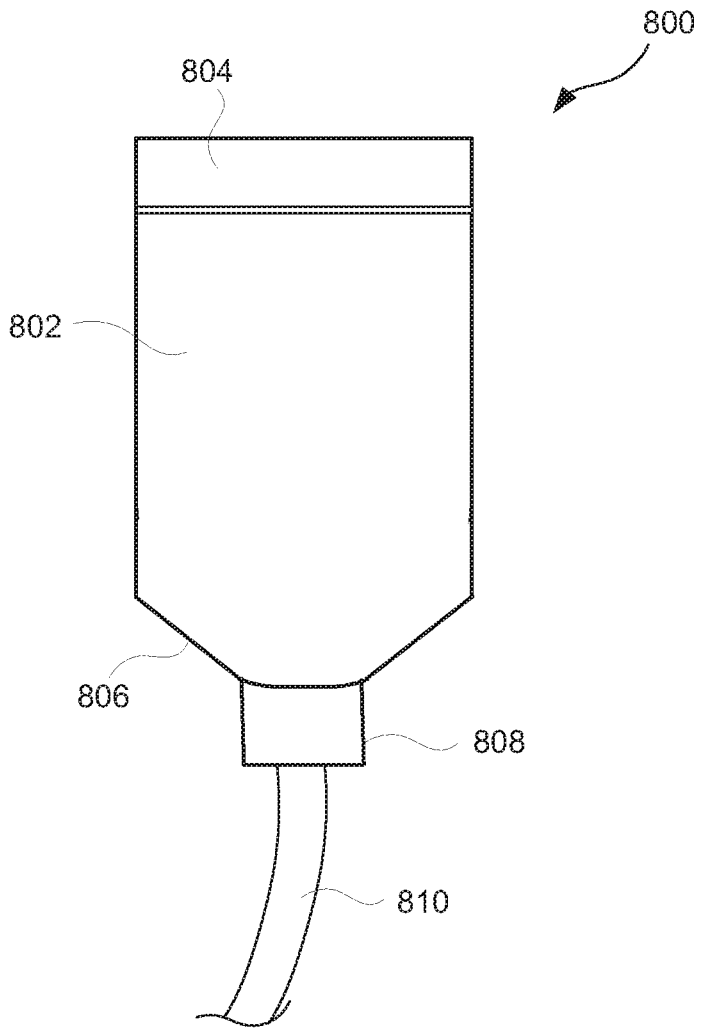
FIG. 8A is a top view of an audio apparatus according to one embodiment.

FIG. 8A is a top view of an audio apparatus 800 according to one embodiment. The audio apparatus 800 can be the same or substantially the same as the audio apparatus 100 illustrated in FIGS. 1-7. However, more generally, the audio apparatus 800 can support a pair of matched microphones. The audio apparatus 800 can, through independent wiring, utilize either of the microphones. In such an embodiment, one of the microphones can be considered an active microphone and the other can be considered a backup microphone.

More particularly, as illustrated in FIG. 8A, the audio apparatus 800 has a housing 802 that contains at least two microphones for the electronic device 800. The housing 802 has a cover 804 that is provided at a top portion of the housing 802. A bottom portion of the housing 802 has or receives a cable support structure 808. The cable support structure 808 couples to the bottom portion of the housing 802. The cable support structure 808 is configured to receive a cable 810 and can secure the cable 810 to the housing 802. The cable support structure 808 can be secured to the housing 802 by mechanical interlock (e.g., complementary molded parts), adhesive, and any other know techniques. The cable 810 can be secured to the cable support structure 810 by adhesive, structural interference (e.g., friction), recess, detents, or any other known techniques.

Figure 8B:
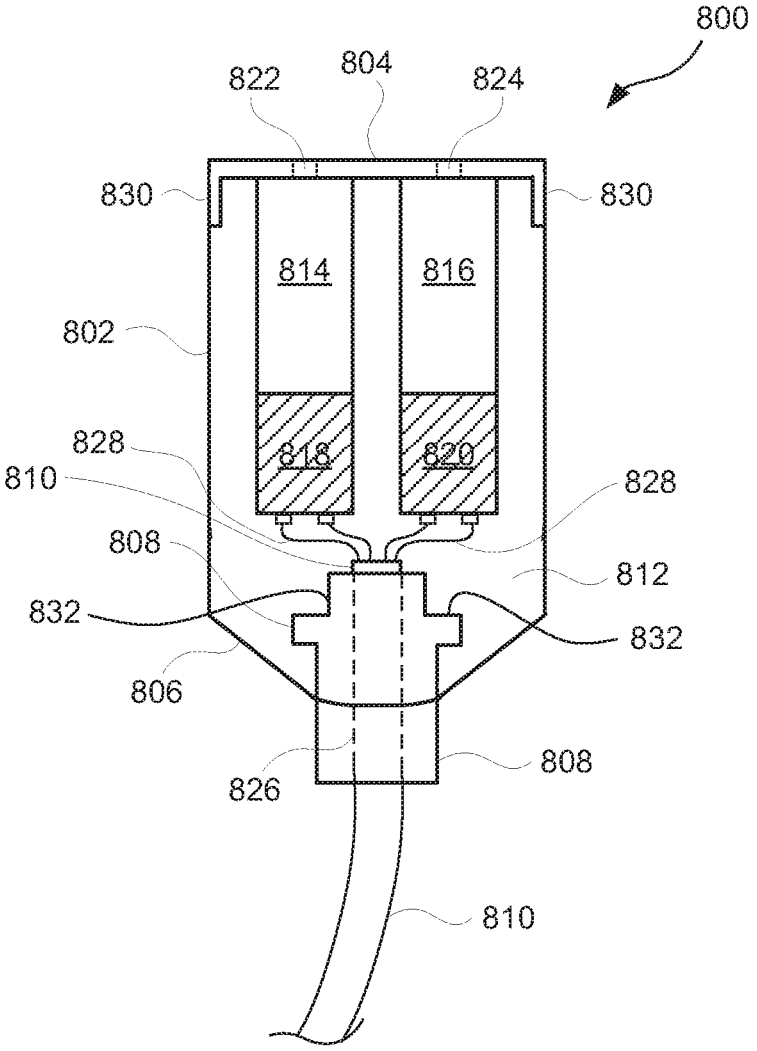
FIG. 8B is a top cross-sectional view of the audio apparatus illustrated in FIG. 8A according to one embodiment.

FIG. 8B is a top cross-sectional view of the audio apparatus 800 illustrated in FIG. 8A according to one embodiment. The housing 802 includes an internal cavity 812. The internal cavity 812 has first and second audio chambers 814 and 816. A first microphone 818 is positioned at a lower portion of the first audio chamber 814. The first microphone 818 is secured in position by any of a variety of means, such as via adhesive, recess, or any other known methods. A second microphone 820 is positioned at a lower portion of the second audio chamber 816. The second microphone 820 is secured in position by any of a variety of means, such as via adhesive, recess, or any other known methods.

The cover 804 includes a first opening (or aperture) 822 that is aligned with the first audio chamber 814. Audio output from the first microphone 818 travels through the first audio chamber 814 and exits through the first opening 822.

The cover 804 includes a second opening (or aperture) 824 that is aligned with the second audio chamber 816. Audio output from the second microphone 820 travels through the second audio chamber 816 and exits through the second opening 824.

The cable support structure 808 provided at the bottom portion of the housing 802 has an upper portion within the internal cavity 812, and has a lower portion external to the housing 802. An opening 826 extends though the cable support structure 808. The cable 810 extends through the opening 826 in the cable support structure 808. The cable 810 includes a plurality of wires 828. In one implementation, the cable 810 carries two wires 828 for the first microphone 818 and two wires 828 for the second microphone 820. As illustrated in FIG. 8B, the respective wires 828 are electrically connected to the corresponding microphone.

The cover 804 also includes an extended peripheral portion 830 provided at the periphery of the cover 804. The extended peripheral portion 830 extends over and couples against or mates with a top portion of the housing 802. In this embodiment, the cover 804 can be referred to as a cap.

It should be notes that the distance from a top surface of the first microphone 818 to the first opening (aperture) 822 in the extended peripheral portion 830 (or to the top of the cover 804) [more generally, to a acoustically reflective surface] is a distance d1, and wherein distance from a top surface of the second microphone 820 to the second opening (aperture) 824 in the extended peripheral portion 830 (or to the top of the cover 804) is a distance d2 [more generally, to a acoustically reflective surface], and wherein the distance d1 is the same (or at least substantially the same) as the distance d2. This ensures that both the first and second microphones 818, 820 have the same acoustic environment. Advantageously, the performance of the audio apparatus 800 is "matched" regardless of which of the first and second microphones 818, 820 is in use.

Alternatively, in another embodiment, the microphones 818 and 820 can be at least partially secured in position using the upper portion of cable support structure 808. In one implementation, although not shown in FIG. 8B, the upper portion can include a support structure 832 against which a bottom of the first microphone 818 and the second microphone 820 can rest or be secured. For example, this would result if the first and second microphones 818 and 820 are position lower in the internal cavity 812 of the housing 802 and the first and second audio chambers 814 and 816 are made deeper. This manner of securing the first and second microphones 818 and 820 likewise ensures that both the first and second microphones 818, 820 have the same acoustic environment.

Figure 9:
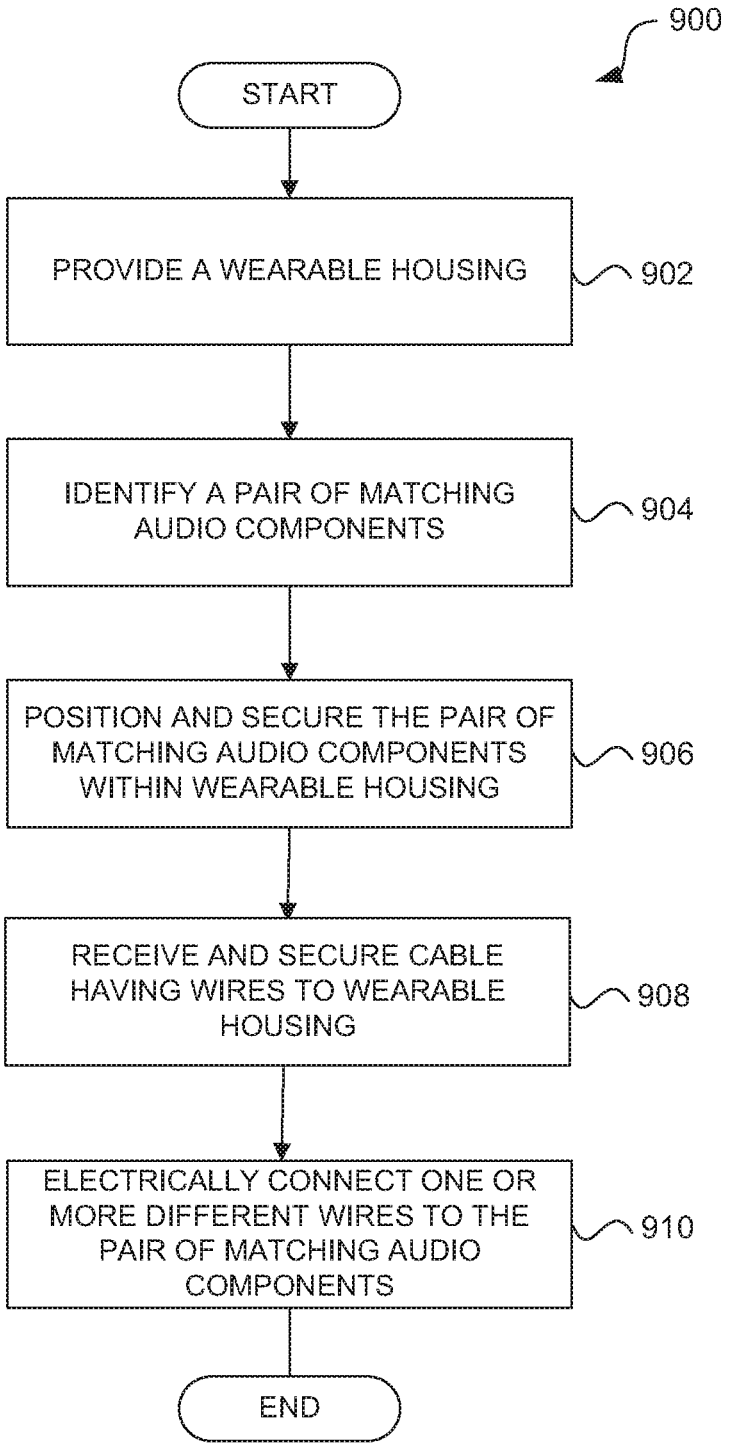
FIG. 9 is a flow diagram of a method for assembling an audio apparatus according to one embodiment.

FIG. 9 is a flow diagram of a method 900 for assembling an audio apparatus according to one embodiment. The audio apparatus can pertain to various of the audio apparatus discussed herein. The method 900 provides 902 a wearable housing for the audio apparatus. The wearable housing may be attached to a user's clothing or body as further discussed below. The audio apparatus includes a pair of audio components that have been acoustically matched. In one implementation, the audio components are microphones. The method 900 thus identifies 904 a pair of matching audio components (e.g., matched audio components). Next, the pair of matching audio components are positioned and secured 906 within the wearable housing. A cable having wires is also received and secured 908 to the wearable housing. Thereafter, the method electrically connects 910 one or more different wires to the pair of matching audio components.

Figure 10:
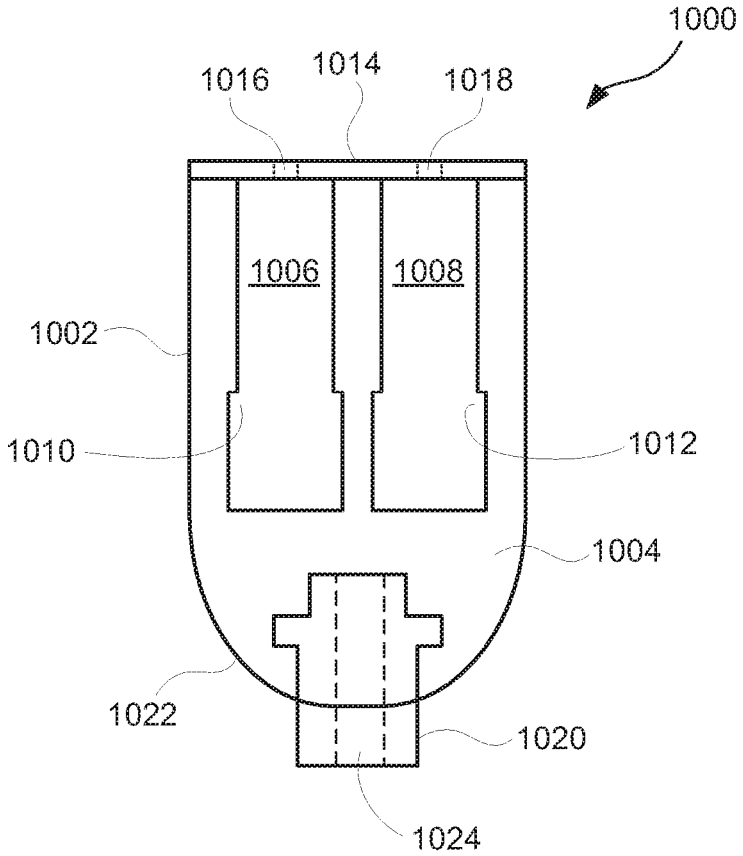
FIG. 10 is a top cross-sectional view of the audio apparatus illustrated according to another embodiment.

FIG. 10 is a top cross-sectional view of the audio apparatus 1000 according to another embodiment. The housing 1002 includes an internal cavity 1004. The internal cavity 1004 has first and second audio chambers 1006 and 1008. A lower portion of the first audio chamber 1006 can include a recess 1010 that is designed to receive a first microphone (not shown). A lower portion of the second audio chamber 1008 can include a recess 1012 that is designed to receive a second microphone (not shown).

The audio apparatus 1000 can have a top portion 1014, which can be an integral portion or a separate top structure. The top portion 1014 can include a first opening (or aperture) 1016 that is aligned with the first audio chamber 1006. Audio output from the first microphone travels through the first audio chamber 1006 and exits through the first opening 1016. The top portion 1014 can include a second opening (or aperture) 1018 that is aligned with the second audio chamber 1008. Audio output from the second microphone travels through the second audio chamber 1008 and exits through the second opening 1018. The depth of the first and second audio chambers 1006, 1008 is the same (or substantially the same) so that the acoustic environment seen by first and second microphones are acoustically equivalent.

The audio apparatus 1000 can also include a cable support structure 1020 provided at a bottom portion 1022 of the housing 1002. The cable support structure 1020 can have an upper portion within the internal cavity 1004, and can have a lower portion external to the housing 1002. An opening 1024 can extend though the cable support structure 1020. A cable (not shown) can extend through the opening 1024 in the cable support structure 1020. As discussed above with reference to FIG. 8B, the cable can carry a plurality of wires for electrical coupling to the microphones that are to be retained in or adjacent the first and second audio chambers 1006, 1008 at least in part by the recesses 1010, 1012.

Figure 11:
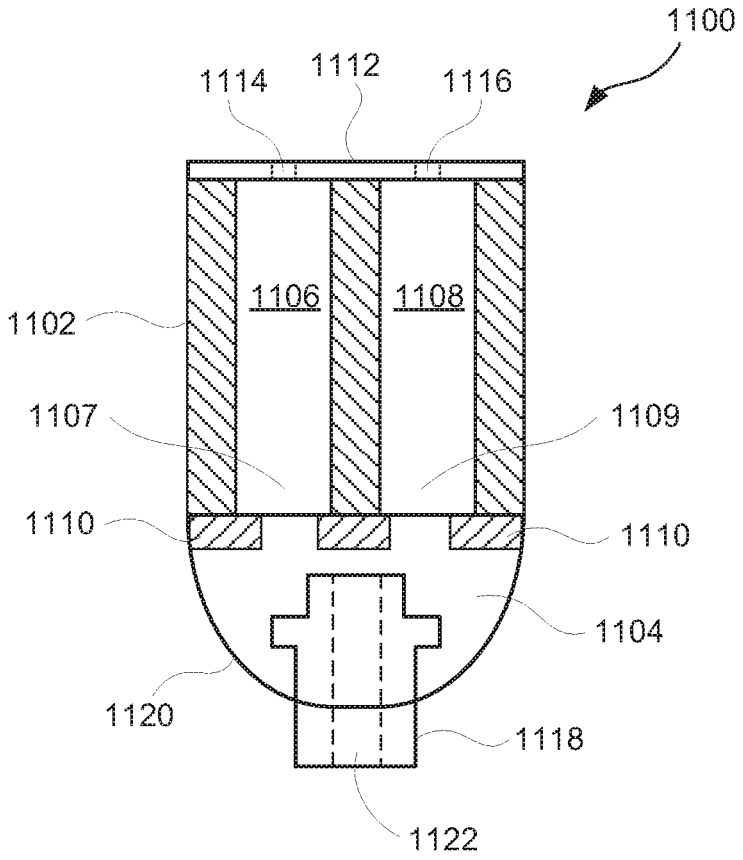
FIG. 11 is a top cross-sectional view of the audio apparatus according to still another embodiment.

FIG. 11 is a top cross-sectional view of the audio apparatus 1100 according to still another embodiment. The housing 1102 includes an internal cavity 1104. The internal cavity 1104 has first and second audio chambers 1106 and 1108. A lower portion 1107 of the first audio chamber 1106 can receive or couple to a first microphone (not shown). A lower portion 110 of the second audio chamber 1108 can receive or couple to a second microphone (not shown).

The audio apparatus 1100 can have a top portion 1112, which can be an integral portion or a separate top structure. The top portion 1112 can include a first opening (or aperture) 1114 that is aligned with the first audio chamber 1106. Audio output from the first microphone travels through the first audio chamber 1106 and exits through the first opening 1114. The top portion 1112 can include a second opening (or aperture) 1116 that is aligned with the second audio chamber 1108. Audio output from the second microphone travels through the second audio chamber 1108 and exits through the second opening 1116. In this embodiment, the internal cavity 1104 can include an internal support structure 1110. The internal support structure 1110 can be provided adjacent the bottom of the first and second audio chambers 1106, 1108 and can provide a support structure to which the first and second microphones can be secured.

The audio apparatus 1100 can also include a cable support structure 1118 provided at a bottom portion 1120 of the housing 1102. The cable support structure 1118 can have an upper portion within the internal cavity 1104, and can have a lower portion external to the housing 1102. An opening 1122 can extend though the cable support structure 1118. A cable (not shown) can extend through the opening 1122 in the cable support structure 1118. The cable can carry a plurality of wires for electrical coupling to the microphones that are received or retained in or adjacent the first and second audio chambers 1106, 1108, such as discussed above with reference to FIG. 8A. Although, as illustrated in FIG. 11, the internal support structure 1110 can be a separate component from the cable support structure 1118, in another embodiment the internal support structure 1110 can be part of the cable support structure 1118, or vice versa.

In one embodiment, the housing for audio component can be capable of being formed in a particular color and/or painted to have a particular color. It is sometimes advantageous to camouflage the presence of the ear mount being worn by a user. In such cases, it is often desirable to camouflage the ear mount by coloring the ear mount to best match the color of the user's skin or clothing.

In one embodiment, the only audio components within a housing of an audio apparatus are microphones. In such case, the audio apparatus is a dedicated apparatus for the microphones.

Audio apparatus according to embodiments of the invention can be assembled according to a method.

The audio apparatus can be attached to a user's clothing or body. The audio apparatus can be attached to or part of a headset or an ear mount. In one embodiment, an ear mount is configured to fit over an ear of a user. The ear mount can include one or more wire grooves to secure wires and/or the one or more audio components. The ear mount can be malleable so its shape can be customized for a given user. The ear mount can also be length alterable for customization of its size as well as placement of audio components. The ear mount can also facilitate rapid setup and/or alteration for individual users whereby different audio components and/or their placement can be customized. The ear mount can also be colored or camouflaged to match the user's skin or clothing. The ear mount can also be referred to as an ear mounting device. Additional details on ear mounts are contained in U.S. Pat. No. 9,706,285, which is incorporated herein by reference for all purposes.

Figure 12:
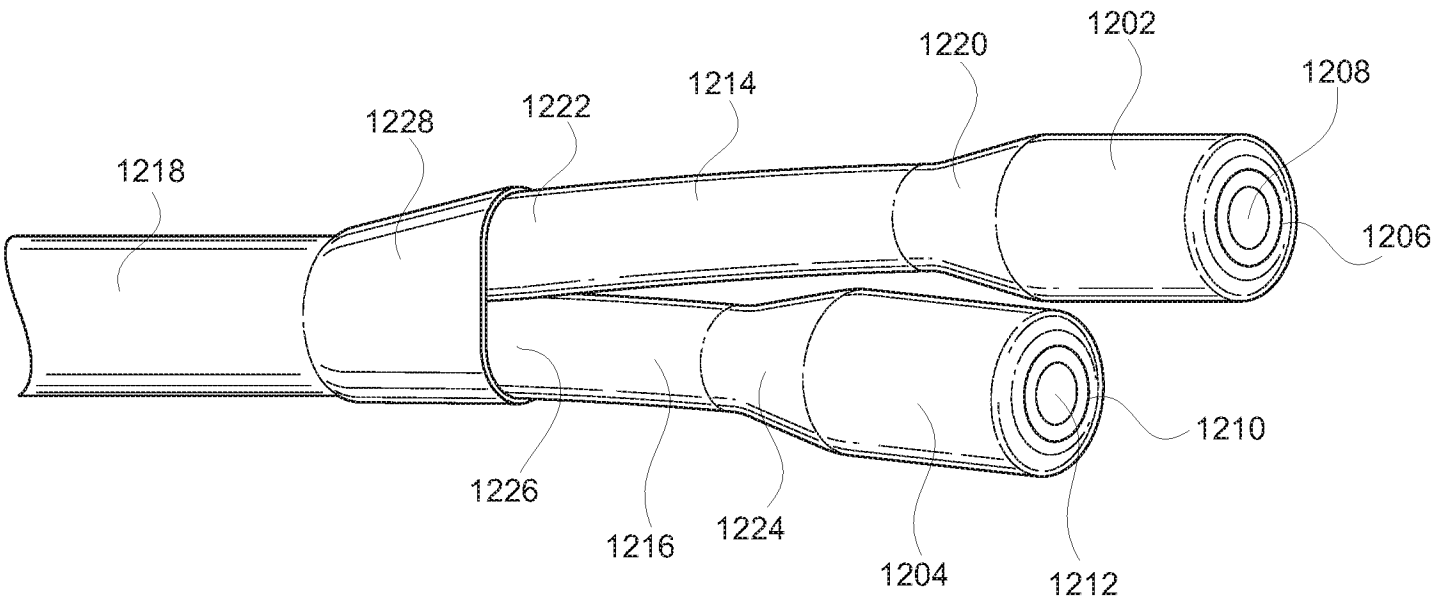
FIG. 12 is a perspective view of an audio apparatus according to another embodiment.

FIG. 12 is a perspective view of an audio apparatus 1200 according to another embodiment. The audio apparatus 1200 can include a first microphone housing 1202 and a second microphone housing 1204. The first microphone housing 1202 can include a first aperture 1206 to an internal cavity containing a first audio component 1208. The first audio component 1208 is, for example, a first microphone for audio pickup. The second microphone housing 1204 can include a second aperture 1210 to an internal cavity containing a second audio component 1212. The second audio component 1212 is, for example, a second microphone for audio pickup.

The audio apparatus 1200 can also include a first microphone extension 1214 and a second microphone extension 1216. The first microphone extension 1214 is coupled between the first microphone housing 1202 and a base member 1218 of the audio apparatus 1200. The second microphone extension 1216 is coupled between the second microphone housing 1204 and the base structure 1218 of the audio apparatus 1200. The base structure 1218 can be configured to receive a cable or can be part of a cable. The cable contains the wiring for each of the first microphone 1208 and the second microphone 1212.

The first microphone extension 1214 has a forward end 1220 and a rear end 1222. The forward end 1220 can be coupled to the first microphone housing 1202. In one implementation, the width or thickness of the first microphone extension 1214 is thinner that the width or thickness of the first microphone housing 1202. In such case, the forward end 1220 can be tapered outward to accommodate the transition in width or thickness to the first microphone housing 1202.

The second microphone extension 1216 has a forward end 1224 and a rear end 1226. The forward end 1224 can be coupled to the second microphone housing 1204. In one implementation, the width or thickness of the second microphone extension 1216 is thinner that the width or thickness of the second microphone housing 1204. In such case, the forward end 1224 can be tapered outward to accommodate the transition in width or thickness to the second microphone housing 1204. The rear end 1222 of the first microphone extension 1214 and the rear end 1226 of the second microphone extension 1216 can be coupled to (including contiguous with) the base member 1218, and restrained in position by a restraining member 1228. The restraining structure 1228 can, for example, be a molded part or a thermally heat shrunk part. Additionally, the restraining structure 1228 can use adhesive or any other known techniques.

To facilitate a low profile configuration, the wearable audio apparatus 1200 can be arranged such that the second microphone housing 1204 is adjacent to and offset from the first microphone housing 1202. In one embodiment, the second microphone extension 1216 can be lengthwise adjacent the first microphone extension 1216, with the second microphone housing 1204 being rearwardly offset from the first microphone housing 1202. In one implementation, the second microphone extension 1216 has shorter length than the length of the first microphone extension 1214. Hence, in such a configuration, a forward portion of the second microphone housing 1204 can be adjacent (e.g., lengthwise adjacent) the first microphone housing 1202, while a rearward portion of the second microphone housing 1204 can be adjacent (e.g., lengthwise adjacent) the first microphone extension 1214.

The first microphone 1208 and the second microphone 1212 can be a pair of matched microphones. The audio apparatus 1200 can, through independent wiring, utilize either of the microphones. In such an embodiment, one of the microphones can be considered an active microphone and the other can be considered a backup microphone. The wiring for the first microphone 1208 can extend from the base structure 1218, through the first microphone extension 1214, and into the first microphone housing 1202. The wiring for the second microphone 1212 can extend from the base structure 1218, through the second microphone extension 1216, and into the first microphone housing 1202.

The length of the second microphone extension 1216 is shorter than the length of the first microphone extension 1214. The second microphone extension 1216 is able to be secured adjacent the first microphone extension 1214. As shown in FIG. 12, the second microphone housing 1212 can be tucked behind and rearward of the first microphone housing 1202. Advantageously, the overall appearance of the audio apparatus 1200 is constrained, even though there are two separately operable microphones. The profile is also minimized by having the second microphone housing 1212 can be tucked behind and offset rearward of the first microphone housing 1202. In other words, the position of the second microphone housing 1212 can be staggered relative to the position of the first microphone housing 1202.

As noted above, one type of audio component for use in the audio component 1200 is a microphone for audio pickup. One suitable microphone is referred to as a lavalier microphone, which is a small electret or dynamic microphone, such as often use for theatre or and public speaking applications in order to allow for hands-free operation. Another type of audio component is an earphone. An earphone can, for example, also be or include an earbud.

Figure 13:
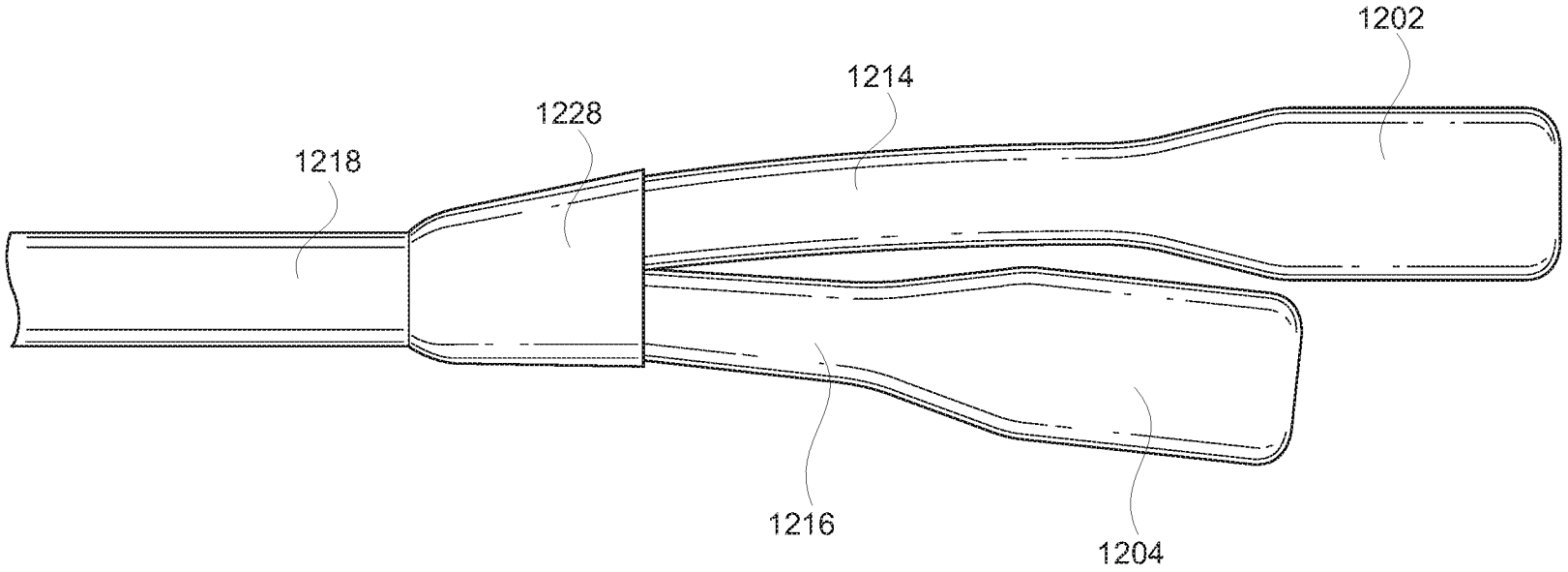
FIG. 13 is a top view of the audio apparatus shown in FIG. 12.
Figure 14:
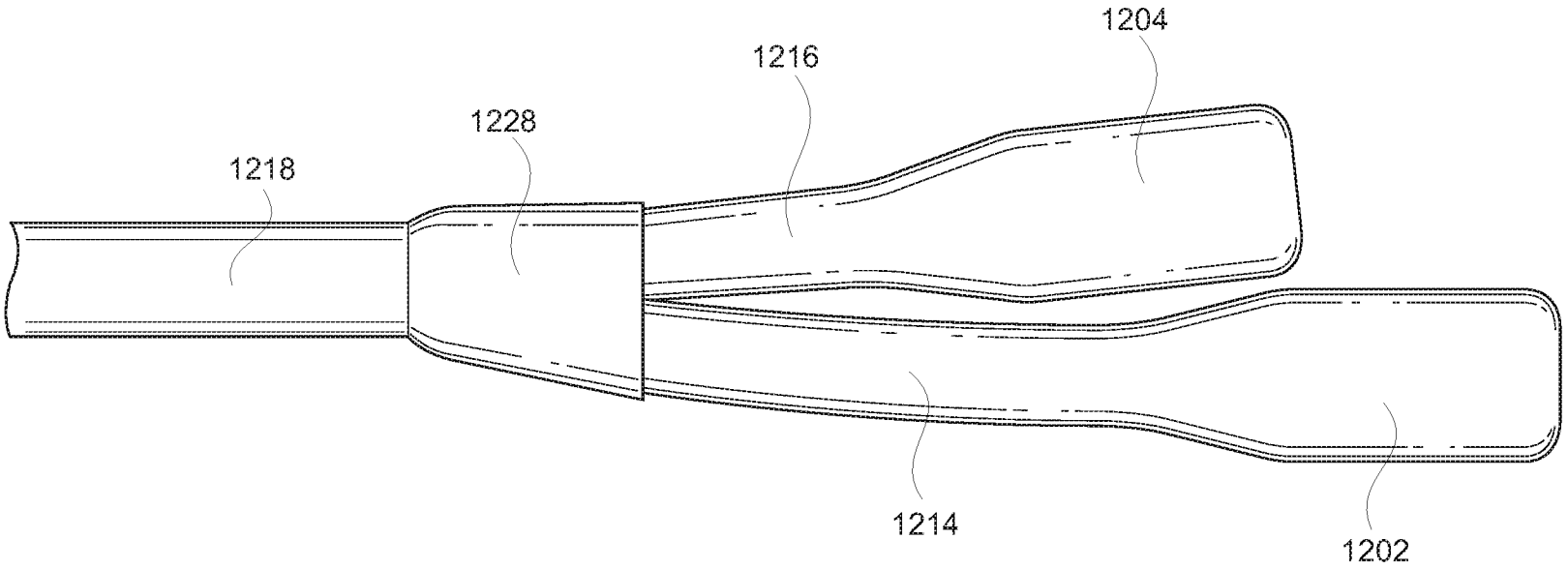
FIG. 14 is a bottom view of the audio apparatus shown in FIG. 12.
Figure 15:
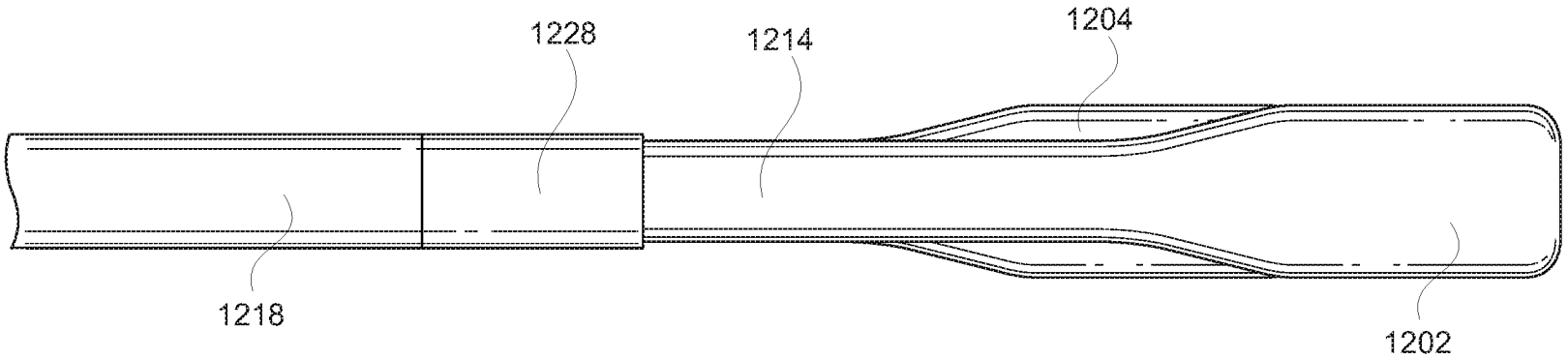
FIG. 15 is a left side view of the audio apparatus shown in FIG. 12.
Figure 16:
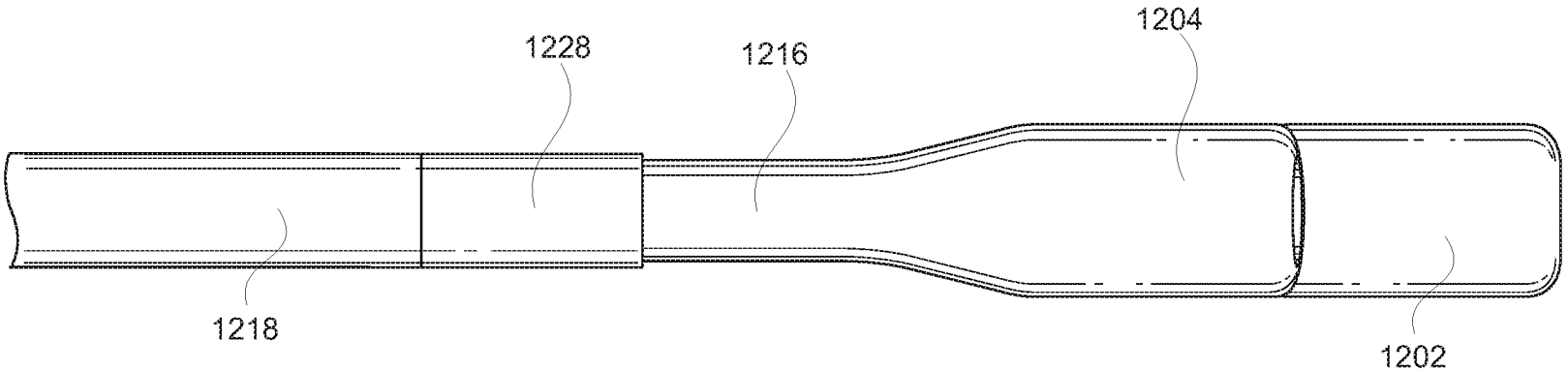
FIG. 16 is a right side view of the audio apparatus shown in FIG. 12.

FIG. 13 is a top view of the audio apparatus 1200 shown in FIG. 12, and FIG. 14 is a bottom view of the audio apparatus 1200 shown in FIG. 12. In addition, FIG. 15 is a left side view of the audio apparatus 1200 shown in FIG. 12, and FIG. 16 is a right side view of the audio apparatus 1200 shown in FIG. 12.

Figure 17:
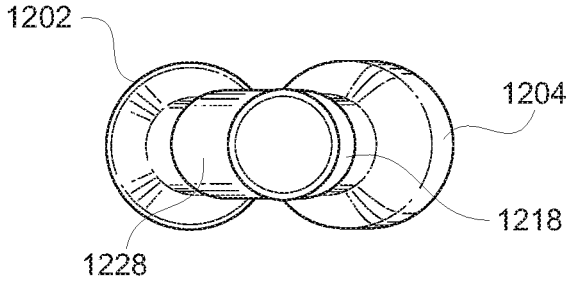
FIG. 17 is a front view of the audio apparatus shown in FIG. 12.

FIG. 17 is a back view of the audio apparatus 1200 shown in FIG. 12. As illustrated, the base member 1218 of the audio apparatus 1200 is or is configured to receive a cable containing wiring for each of the first and second microphones 1208 and 1212. Regardless, the cable can be secure to the audio apparatus 1200.

Figure 18:
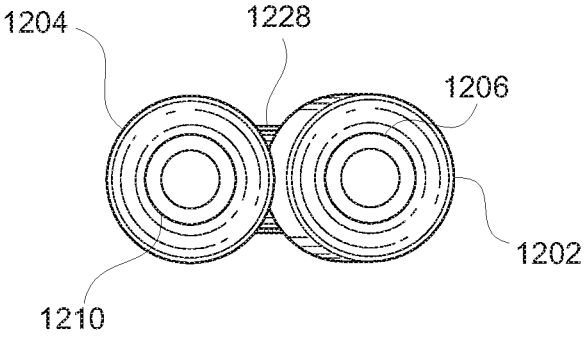
FIG. 18 is a back view of the audio apparatus shown in FIG. 12.

FIG. 18 is a front view of the audio apparatus 1200 shown in FIG. 12. As illustrated, the front surface of the first microphone housing 1202 and the second microphone housing 1204 include the first and second apertures 1206 and 1210, respectively. The first and second apertures 1206 and 1210 facilitate audio pickup by the first and second microphones 1208 and 1212, respectively.

The particular configuration of the audio apparatus shown in FIGS. 12-18 is exemplary. Those skilled in the art will understand that the configuration and ornamental appearance of the audio apparatus can differ depending on implementation. As one example, the number of apertures for audio output can vary. As another example, the shape or configuration of the audio apparatus can vary. In one particular embodiment, the audio apparatus can by sized as follows: (i) the first and second microphone housing 1202 and 1204 can have a diameter of about 3.3 mm, and a length of 6 mm; (ii) the first and second microphone extension 1214 and 1216 can have a diameter of about 1.9 mm; (iii) the restraining member 1228 can have a thickness of about 3.8 mm; and (iv) the base member 1218 can have a diameter of about 2 mm.

An audio apparatus is also described and illustrated in U.S. Design application Ser. No. 29/621,415, filed Oct. 7, 2017, and entitled WEARABLE MICROPHONE, which is incorporated herein by reference for all purposes.

Another audio apparatus is also described and illustrated in U.S. Design application Ser. No. 29/704,288, filed Sep. 3, 2019, and entitled WEARABLE MICROPHONE, which is incorporated herein by reference for all purposes.

The various aspects, features, embodiments or implementations of the invention described above can be used alone or in various combinations.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A wearable audio apparatus, comprising:

a first microphone housing having a first internal cavity;

a first microphone positioned and secured within the first internal cavity of the first microphone housing, the first microphone having a first audio responsiveness;

a second microphone housing having a second internal cavity;

a second microphone positioned and secured within the second internal cavity of the second microphone housing, the second microphone having a second audio responsiveness;

a base member;

a first microphone extension having a forward end and a base end, the forward end being coupled to the first microphone housing, the base end being coupled to the base member; and a second microphone extension having a forward end and a base end, the forward end being coupled to the second microphone housing, the base end being coupled to the base member, wherein the first microphone extension has a first length, and the second microphone extension has a second length, and the first length is longer than the second length, wherein the second microphone extension is lengthwise adjacent the first microphone extension, wherein the second microphone housing is fixedly positioned such that the second microphone housing is at least partially adjacent and rearwardly offset from the first microphone housing, and wherein the second microphone serves as a back-up microphone to the first microphone.

2. A wearable audio apparatus as recited in claim 1, wherein the wearable audio apparatus comprises:

a restraining member being configured to secure the base end of the first microphone extension adjacent the base end of the second microphone extension.

3. A wearable audio apparatus as recited in claim 1, wherein the first microphone extension has a first extension thickness, and the first microphone housing has a first housing thickness, the first housing thickness being greater than the first extension thickness, and wherein the forward end of the first microphone extension is tapered outward to interface between the first microphone extension and the first microphone housing, and wherein the second microphone extension has a second extension thickness, the second housing thickness being greater than the second extension thickness, and the second microphone housing has a second housing thickness, and wherein the forward end of the second microphone extension is tapered outward to interface between the second microphone extension and the second microphone housing.

4. A wearable audio apparatus as recited in claim 1, wherein the second microphone extension is fixedly positioned at least partially adjacent the first microphone extension.

5. A wearable audio apparatus as recited in claim 1, wherein a forward portion of the second microphone housing is adjacent the first microphone housing, and wherein a rearward portion of the second microphone housing is adjacent the first microphone extension.

6. A wearable audio apparatus as recited in claim 1, wherein the first microphone housing having a first aperture, and wherein the second microphone housing having a second aperture.

7. A wearable audio apparatus as recited in claim 1, the first microphone housing and the second microphone housing are staggered.

8. A wearable audio apparatus as recited in claim 1, wherein the first audio responsiveness and the second audio responsiveness are matched to within 10%.

9. A wearable audio apparatus as recited in claim 1, wherein the first audio responsiveness and the second audio responsiveness are matched to within 5%.

10. A wearable audio apparatus as recited in claim 1, wherein the base member is or couples to a single cable having a plurality of wires.

11. An audio apparatus as recited in claim 10, wherein the plurality of wires in the cable includes first, second, third and fourth wires, wherein the first and second wires are electrically connected to the first microphone, and wherein the third and fourth wires are electrically connected to the second microphone.

12. An audio apparatus as recited in claim 10, wherein the wires in the cable are used to independently electrically connect to the first and second microphones.

13. A wearable audio apparatus as recited in claim 1, wherein the wearable audio apparatus is a dual microphone lavalier.

14. A wearable audio apparatus as recited in claim 1, wherein the wearable audio apparatus includes no other audio components other than microphones.

* * * * *